US005494454A

United States Patent [19]

Johnsen

[11] Patent Number: 5,494,454

[45] Date of Patent: Feb. 27, 1996

[54] CONTACT HOUSING FOR COUPLING TO A COAXIAL CABLE

[76] Inventor: Kare Johnsen, N-4791, Lillesand, Norway

[21] Appl. No.: 302,934

[22] PCT Filed: Mar. 24, 1993

[86] PCT No.: PCT/NO93/00047

§ 371 Date: Sep. 21, 1994

§ 102(e) Date: Sep. 21, 1994

[87] PCT Pub. No.: WO93/19498

PCT Pub. Date: Sep. 30, 1993

[30] Foreign Application Priority Data

Mar. 26, 1992 [NO] Norway ..... 921173

[51] Int. Cl.[6] ..... H01R 4/24

[52] U.S. Cl. ..... 439/394; 439/578

[58] Field of Search ..... 439/394, 582, 439/583, 584, 578, 585

[56] References Cited

U.S. PATENT DOCUMENTS

| | | | |
|---|---|---|---|
| 4,881,912 | 11/1989 | Thommen et al. | 439/585 |
| 4,892,491 | 1/1990 | Budano, II et al. | 439/582 |
| 4,932,898 | 6/1990 | Goodman et al. | 439/582 |
| 5,037,329 | 8/1991 | Wright | 439/582 |

FOREIGN PATENT DOCUMENTS

| | | | |
|---|---|---|---|
| 90538 | 10/1983 | European Pat. Off. . | |
| 228750 | 7/1987 | European Pat. Off. . | |
| 412412 | 2/1991 | European Pat. Off. . | |
| 2936616 | 3/1981 | Germany | 439/394 |
| 54-159690 | 12/1979 | Japan | 439/394 |

*Primary Examiner*—David L. Pirlot
*Assistant Examiner*—Jill DeMello
*Attorney, Agent, or Firm*—Andrus, Sceales, Starke & Sawall

[57] ABSTRACT

A contact housing for coupling to a coaxial cable (1) comprises a housing (5) of electrically conducting material, which forms a connector for the screen (3) of the coaxial cable (1), and a therefrom insulated (7) coupler (6) for electrical coupling to the center conductor (2) of the coaxial cable (1). The contact housing can be coupled to coaxial cables of differing cross-sectional dimensions with minor modification. To this end, the center conductor coupler (6) of the contact housing (5) is formed to be capable of being brought into firmly retaining, electrical contact with the center conductor (2) of the coaxial cable (1). The center conductor coupler cooperates with a locking means (9) for locking the connection so established. The contact housing (5) has a locking sleeve (11) of electrically conducting material, and which can be connected firmly with the contact housing (5). The locking sleeve (11) is adapted to cooperate with knife contacts (10, 10'; 14, 14') having varying widths laterally of the axis of the locking sleeve (11). The width thereof can be adjusted to the cross-sectional dimensions of the particular coaxial cable (1) being connected.

2 Claims, 3 Drawing Sheets

CONTACT HOUSING FOR COUPLING TO A COAXIAL CABLE

The present invention relates to a contact housing for coupling to a coaxial cable having varying cross-sectional dimension, comprising a housing of electrically conducting material and constituting coupling means for the screen or shield coaxial cable, and a therefrom insulated centre conductor coupling means, for electrically conducting coupling to the centre conductor of the coaxial cable.

As well known, the conductor of a coaxial cable is positioned centrally within the cable and insulated from a conducting screen or shield surrounded by the external insulation.

With a coaxial cable coupling, the cable nut and locking disc are threaded, as known per se, into the coaxial cable prior to the external jacket being scraped off over a length of about 3–4 cm. The screen or shield is cut about 9 cm from the end of the external jacket, and the screen sleeve is threaded in until it stops against the end face of the external jacket. Thereafter, the strands of the screen are splintered and folded back over the screen sleeve. The centre conductor is cut at 5,5 mm and is stripped of insulation, such that the-insulation becomes 3,5 mm and stripped centre conductor 2 mm. The foil screen can overlap the dielectric by about 2 mm. Prior to the coaxial cable being mounted, the centre conductor point is threaded into an insulation piece and conducted into the contact housing. A centre sleeve is threaded over the centre conductor which is mounted to the contact housing and screwed into place by means of a wrench or an adjustable spanner. Thereafter, the centre conductor point is soldered to an electrically conducting portion of the contact housing.

Prior art contact housings of this general kind are only in a position to be coupled to a coaxial cable of one particular dimension, and the soldering represents a considerable problem with respect to fault finding in order to determine whether the soldering is poor. As a result of the soldering, hut also due to other factors, this way of mounting is cumbersome and time-consuming.

Improved contact housings of the kind defined introductorily distinguish themselves through mole suitable centre conductor coupling means and cooperating locking means therefore, see EP-412412. A resilient attachment of the centre conductor of a coaxial cable in such a contact housing is known from U.S. Pat. No. 4,892,491.

According to the present invention one has aimed at providing a contact housing for coupling to coaxial cables having varying cross-sectional dimensions, and render unnecessary said soldering operation, and wherein the coupling operation is substantially simplified in relation to conventional technique.

In accordance with the invention, this object is realized through designing the coaxial cable contact housing as set forth in the following claims.

In accordance with the invention, a contact housing of the kind defined introductorily is assigned a locking sleeve of electrically conducting material and which can be connected firmly with the contact housing, said locking sleeve being formed to accommodate and cooperate lockably with knife contacts having a varying width extent laterally of the axis of the locking sleeve and the width thereof being adjusted to the cross-sectional dimension of the coaxial cable concerned.

Examples of preferred embodiments of the invention are further explained in the following, reference being made to the accompanying drawings, wherein.

Figure 1:
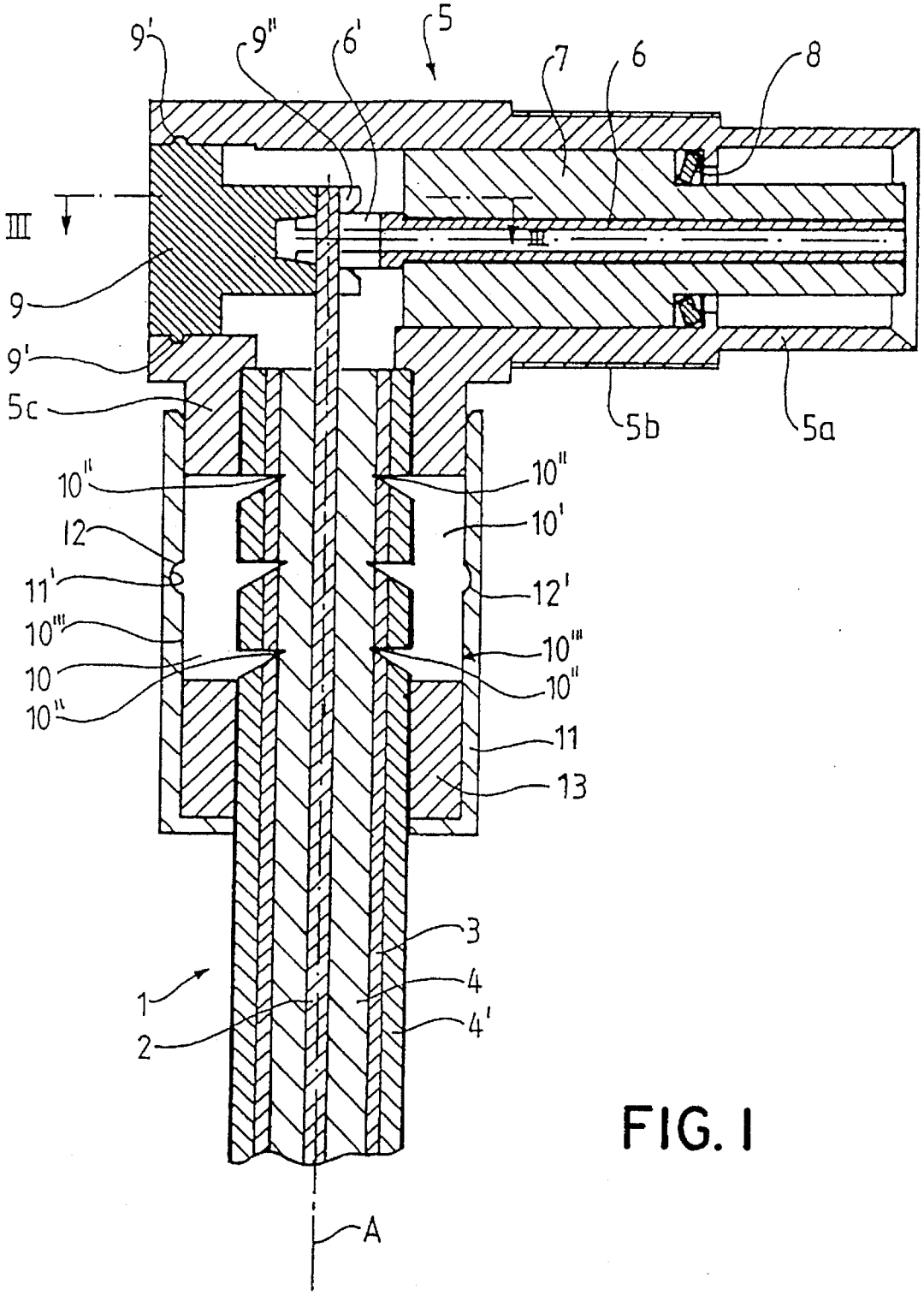
FIG. 1 shows an axial section through a contact housing according to the invention, a relatively thick coaxial cable being fitted into the same.
Figure 2:
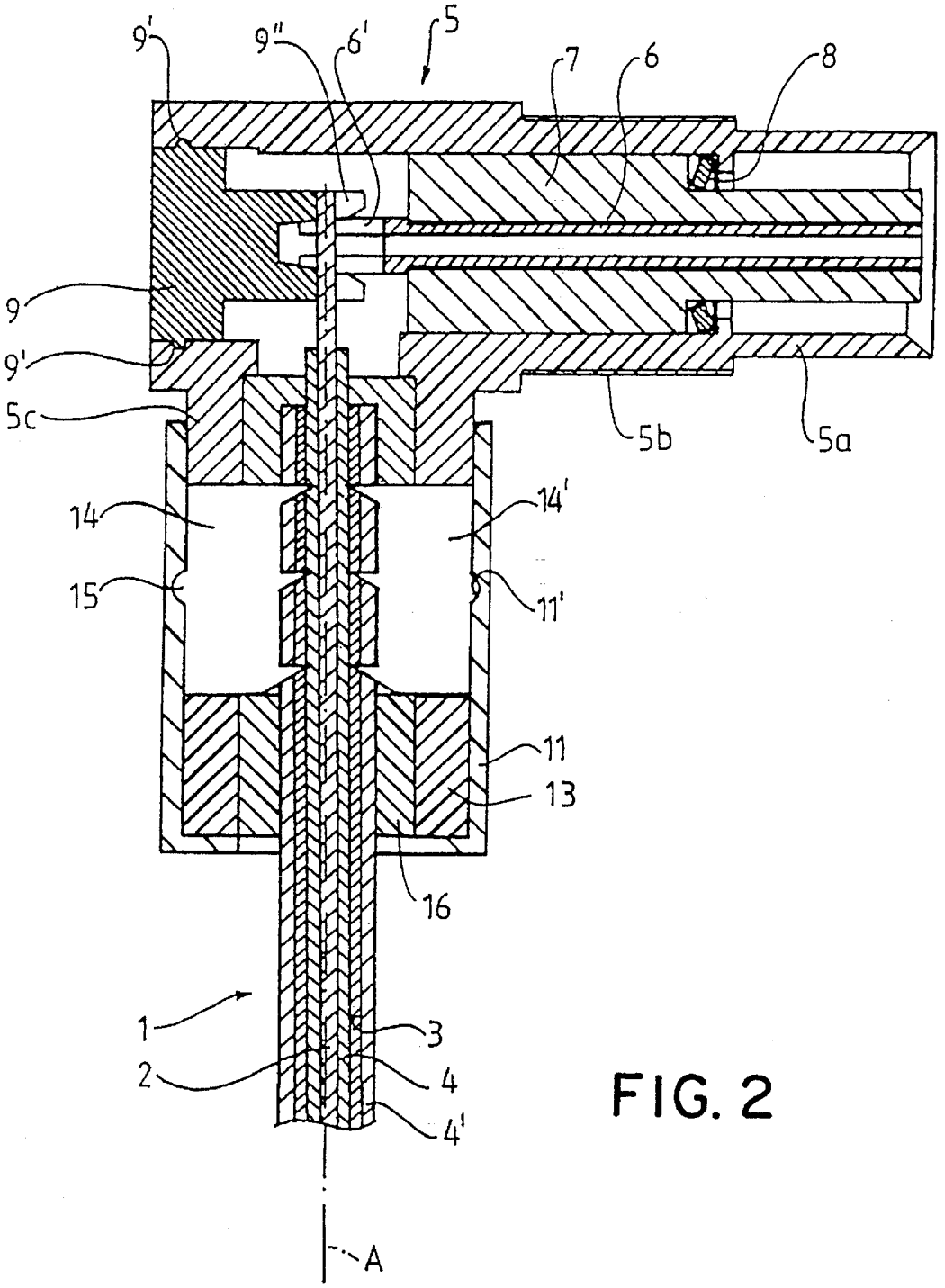
FIG. 2 shows a corresponding axial section through a contact housing insignificantly modified in relation to the contact housing of FIG. 1, a relatively thin coaxial cable being fitted into the same.

First, reference is made to FIG. 1, wherein reference numeral 1 generally denotes a coaxial cable comprising an internal centre conductor 2, an external screen or shield 3 of conducting material, an intermediate insulation 4 and an external insulation 4' The very same reference numerals 1–4 are used in FIG. 2 for the thinner coaxial cable.

The contact housing which is made of metal, is denoted by the reference numeral 5 and consists substantially of a sleeve-shaped part **5*a*, having an externally threaded portion 5*b*, and a laterally directed annular flange 5*c*. The sleeve-shaped part 5*a* of the contact housing 5 accommodates the centre conductor 6 of the contact housing 5, the conductor 6 being insulated by insulation 7 against the contact housing 5. Corresponding reference numerals are used in FIG. 2**.

The threads **5*b* of the contact housing 5** can be used for the fitting thereof on a stationary or movable member.

For coupling of the centre conductor 2 of the coaxial cable 1, the centre conductor 6 of the contact housing 5 has a bifurcated point 6', intermediate the legs thereof the centre conductor 2 of the coaxial cable 1 is caught during the fitting in. The insulation piece 7 which surrounds the contact housing's 5 centre conductor 6 with a press fit, is assigned a spring disc 8 seeking to press the centre conductor 6 of the contact housing 5 towards the operative position, see FIG. 1, but allowing withdrawal of the centre conductor 6 of the contact housing 5 in order to let the coaxial cable's centre conductor 2 pass prior to the coupling thereof to the contact housing's 5 centre conductor 6. As soon as coupling/contact is established between the two centre conductors 2 and 6, a locking piece 9 is urged ito locking position in order to lock the connection established between the two centre conductors 2, 6.

Figure 3:
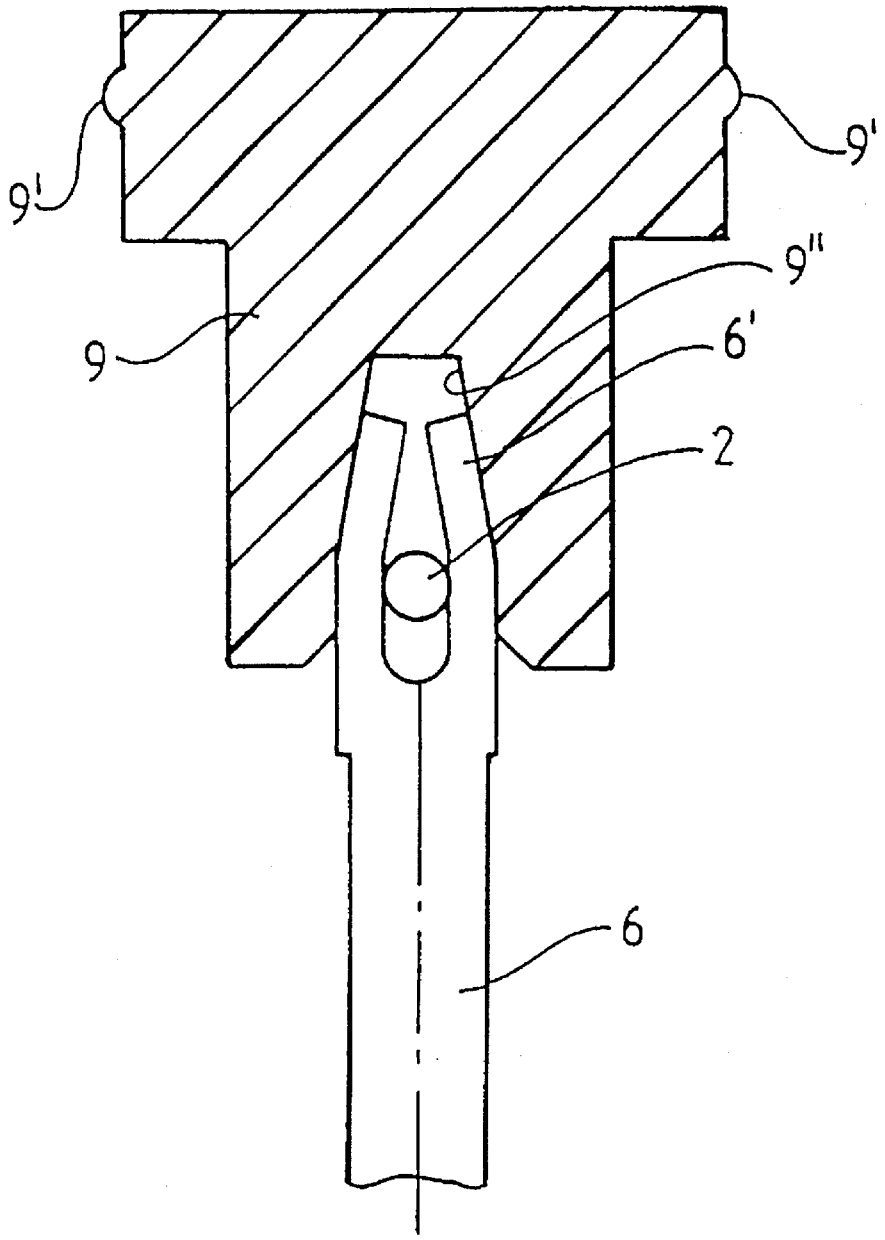
FIG. 3 is a cross- sectional view along the line III—III in FIG. 1, showing merely means for coupling to the centre conductor of the coaxial cable, namely a portion of a centre conductor coupling means of metal and a locking means of non-conducting material both incorporated into the contact housing.

This locking piece 9 appears best from FIG. 3, wherein it is shown in engagement with the contact housing's 5 centre conductor 6 which, in its turn, retains the coaxial cable's centre conductor 2 within its bifurcated end or point 6'.

The locking piece 9 is displaceably arranged within the sleeve-shaped Dart **5*a* of the contact housing 5 and can be locked into the latter in the locking position in that a circumferential bead 9' on the locking piece 9 comes into engagement with a corresponding circumferential groove formed internally in the sleeve-shaped part 5*a* of the contact housing 5**.

The locking piece 9 is formed with a cavity 9" tapering away from the contact housing centre conductor's point 6' for clamping the centre conductor point 6' while the latter retains the coaxial cable centre conductor 2, in order to clamp and lock the connection established between the coaxial cable centre conductor 2 and the contact housing centre conductor 6, 6'. Similar to the centre conductor point 6', also the locking piece's 9 clamping portion with the cavity 9" is double-bifurcated.

According to the invention, for the electrically conducting connection of the contact housing 5 to the screen 3 of the coaxial cable 1, there have been arranged two diametrally opposing knife contacts 10, 10' the knives thereof being denoted 10". These knives are clamped into the screen 3 of the coaxial cable 1 by means of a pliers or tongs, whereby the radially outermost edges 10" of the knife contacts 10 10' subsequent to the clamping-in, will be situated at a certain distance from the axis A of the lateral ring flange or branch socket 5*c* of the contact housing 5. This because the electrically conducting knife engagement of the knife contacts 10, 10' into the screen 3 of the coaxial cable 1 thereafter is secured by means of a locking sleeve 1i of electrically conducting material and formed with an internal circumferential groove 11' into which a circumferential bead 12, 12' on each of the knife contacts will snap when the sleeve 11 is fitted into place.

With one end portion thereof, this locking sleeve 11 is intended to be pushed into engagement with the branch socket 5*c* of the contact housing 5, and has at the other end thereof an internal support ring 13 for the coaxial cable 1. The very same locking sleeve 11 shall also be capable of being used in connection with the thinner coaxial cable 1 of FIG. 2 and, therefore, the same reference numerals as in FIG. 1 have been used here.

According to FIG. 2, the coaxial cable 1 is substantially thinner than in FIG. 1. Nevertheless, the same contact housing, inclusive the locking sleeve 11, can be used. In order to enable this, each of the knife contacts 14, 14' in FIG. 2 is broader than the knife contacts 10, 10' of FIG. 1 by an amount that corresponds to the half diameter difference between the thick and the thin cable. In addition to this modification of the knife contacts 14, 14' which have beads 15 for engagement into internal circumferential grooves 11' of the locking sleeve 11, only a sleeve-shaped casing 16 is fitted in between the support ring of the locking sleeve 11 and the coaxial cable 1. Thus, a contact housing 5 according to the invention can be adapted to coaxial cables 1 having strongly differing dimensions, merely through exchanging the knife contacts and, possibly, arranging a casing 16 of insulating material.

I claim:

1. A coupler for coupling to a coaxial cable (1), the coaxial cable having a dimension transverse to an axis of the coaxial cable, said coupler being capable of coupling to coaxial cables having different transverse dimension, said coupler comprising a contact housing (5) of electrically conducting material forming coupling means for a shield (3) of the coaxial cable (1), said coupler further comprising a coupling means (6) for a center conductor of said cable insulated from said contact housing, said contact housing (5) having a locking sleeve (11) of electrically conducting material which can be connected firmly with the contact housing (5), said locking sleeve (11) being adapted to accommodate and cooperate lockably with knife contacts (10, 10'; 14, 14') extendable laterally toward the axis of the coaxial cable (11) by a variable amount, the amount of extension being adjusted in accordance with the transverse dimension of the coaxial cable (1) to which the coupler is coupled.

2. A coupler as set forth in claim 1, characterized in that the coupling means (6) for the center conductor is mounted on a spring-loaded (8) insulation body (7) displaceably mounted in said housing, which body urges the coupling means (6) for the center conductor towards an operative position of engagement with the center conductor (2).

* * * * *